US008672701B2

(12) United States Patent
Andresen

(10) Patent No.: US 8,672,701 B2
(45) Date of Patent: Mar. 18, 2014

(54) CABLE CONNECTION DEVICE

(75) Inventor: Jens Andresen, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 120 days.

(21) Appl. No.: 13/266,454

(22) PCT Filed: Apr. 27, 2010

(86) PCT No.: PCT/EP2010/002571
§ 371 (c)(1),
(2), (4) Date: Oct. 26, 2011

(87) PCT Pub. No.: WO2010/124841
PCT Pub. Date: Nov. 4, 2010

(65) Prior Publication Data

US 2012/0052717 A1 Mar. 1, 2012

(30) Foreign Application Priority Data

Apr. 27, 2009 (DE) ..... 10 2009 018 714

(51) Int. Cl.
*H01R 4/24* (2006.01)

(52) U.S. Cl.
USPC ..... 439/395; 439/415; 439/444

(58) Field of Classification Search
USPC ..... 439/415–417, 444
See application file for complete search history.

(56) References Cited

U.S. PATENT DOCUMENTS

| | | | | | |
|---|---|---|---|---|---|
| 5,305,547 | A | * | 4/1994 | Weiss | 439/395 |
| 5,439,388 | A | * | 8/1995 | Weiss et al. | 439/417 |
| 5,460,539 | A | * | 10/1995 | Gallone | 439/425 |
| 5,601,448 | A | * | 2/1997 | Poon | 439/419 |

FOREIGN PATENT DOCUMENTS

| | | | |
|---|---|---|---|
| DE | 10022547 | A1 | 11/2001 |
| DE | 102009018714 | B3 | 4/2009 |
| EP | 0980117 | A2 | 2/2000 |
| WO | 2004045028 | A1 | 5/2004 |

OTHER PUBLICATIONS

English translation of International Search Report mailed Sep. 21, 2010, in related International Application No. PCT/EP2010/002571, filed Apr. 27, 2010.
English translation of Written Opinion mailed Sep. 21, 2010, in related International Application No. PCT/EP2010/002571, filed Apr. 27, 2010.

* cited by examiner

*Primary Examiner* — Hien Vu
(74) *Attorney, Agent, or Firm* — TechLaw LLP; Jonathan A. Kidney

(57) ABSTRACT

A cable connection device is described for electroconductive connection of a preferably multiwire cable, comprising a forcing nut, a receiving device and a contact carrier. The cable is guided through the forcing nut and through an opening of the receiving device, which comprises a wire receiving element. A stripped wire section of the cable can be positioned radially to the longitudinal axis of the cable connection device, on the wire receiving element, and the forcing nut can be screwed onto the contact carrier so that the forcing nut engages around the receiving device, the wire receiving element is directed towards the contact carrier and the receiving device can be pushed towards the contact carrier by the screwing nut. The cable has a compact structure and can be very easily and/or rapidly connected to a cable, and/or produced very economically on the basis of its simple construction and few individual parts.

16 Claims, 3 Drawing Sheets

CABLE CONNECTION DEVICE

CROSS-REFERENCE TO RELATED APPLICATIONS

This application is a national stage filing of PCT Application No. PCT/EP2010/002571 filed 27 Apr. 2010 (27 Apr. 2010) which claims priority to German Patent Application No. 102009018714.6 (DE), titled "CABLE CONNECTION DEVICE," filed 27 Apr. 2009 (27 Apr. 2009), the contents of which are hereby incorporated by reference in its entirety.

FIELD

The invention relates to a cable connecting device for electrically conductive connection using a multicore cable, having a compression nut, a holding device and a contact support.

BACKGROUND

Cable connecting devices are of major importance in various fields of application, such as industrial connection technology, and are used, for example, for connection of electrical components and/or electrical appliances, such as electrical parts, electrical devices and/or electrical apparatuses. Various cable connecting devices are known from the prior art, which are also referred to as electrical plug connectors and/or power distributors, and/or which can be used as a cable connection device. Cable connecting devices such as these are described in numerous versions, for example in Ingress Protection Class IP 6X.

In addition to simple assembly, such cable connecting devices must ensure a permanently high level of operational safety, in particular when used outdoors and when subject to the loads involved therewith from widely different weather influences. The cable connecting devices which are known from the prior art and can be used for a cable core having a relatively large conductor cross section, are particularly complex to install and often have a more than proportional size because of the high connection forces, compared to cable connecting devices for relatively small line cross sections. In particular, power distribution to Ingress Protection Class IP 6X cannot be achieved satisfactorily for large conductor cross sections by means of the cable connecting devices known from the prior art.

Consequently there is a need for a cable connecting device which can be assembled easily and can be produced cost-effectively, in particular for a relatively large cable core conductor cross section. These and other needs are addressed by various systems and methods as elucidated in the following description.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In another aspect of the present disclosure, a cable connecting device for electrically conductive connection of a cable is provided, comprising: a compression nut; a holding device with an opening and a core holder; and a contact support, wherein the cable can be passed through the compression nut and through the opening in the holding device, wherein a core of a stripped section of the cable can be positioned radially with respect to a longitudinal axis of the cable connecting device on the core holder, and the compression nut can be screwed onto the contact support such that the compression nut clasps the holding device, the core holder facing the contact support, and the holding device can be pressed against the contact support by screwing up the compression nut.

In another aspect of the present disclosure, a method of electrically connecting of a cable to an electrical appliance, or for electrical connection of two cables is provided, comprising: a connecting device comprising: a compression nut; a holding device with an opening and a core holder; and a contact support, passing the cable through the compression nut and through the opening in the holding device; positioning a core of a stripped section of the cable radially with respect to a longitudinal axis of the cable connecting device on the core holder; and screwing the compression nut onto the contact support such that the compression nut clasps the holding device, the core holder facing the contact support, and the holding device is pressed against the contact support by screwing up the compression nut.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings. As such, other aspects of the disclosure are found throughout the specification.

DETAILED DESCRIPTION

Figure 1:
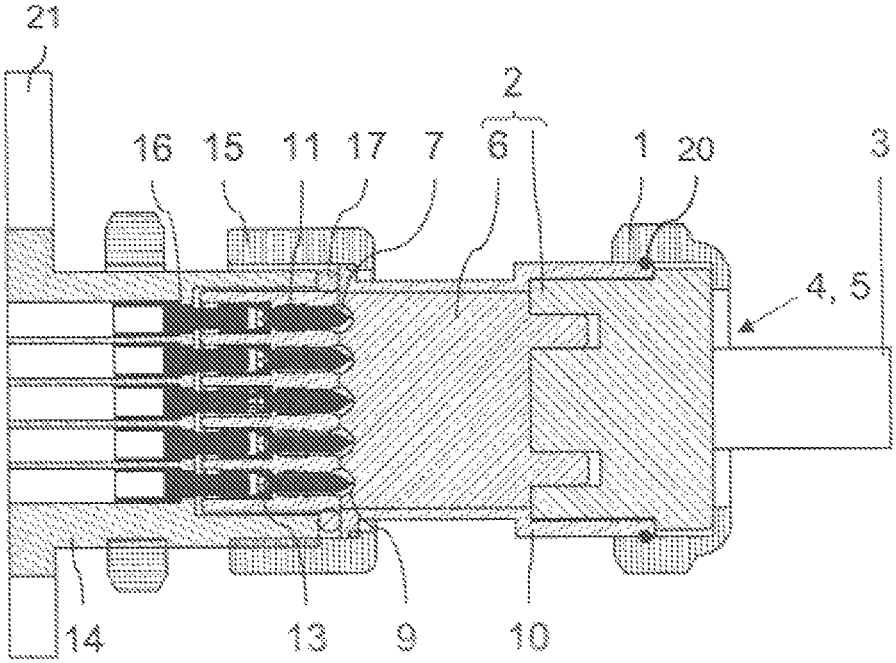
FIG. 1 shows a section view of a cable connecting device according to an exemplary embodiment.

Various exemplary embodiments specify a cable connecting device which can be assembled easily and can be produced cost-effectively, in particular for a relatively large cable core conductor cross section.

These aspects are achieved by a cable connecting device for electrically conductive connection of a preferably multicore cable, having a compression nut, a holding device and a contact support, wherein the cable can be passed through the compression nut and through an opening in the holding device, the holding device has a core hold, in which case a core of a stripped section of the cable can be positioned radially with respect to the longitudinal axis of the cable connecting device on the core holder, and the compression nut can be screwed onto the contact support such that the compression nut clasps the holding device, the core holder faces the contact support, and the holding device can be pressed against the contact support by screwing up the compression nut.

A cable connecting device is therefore specified for electrically conductive connection of a preferably multicore cable, which can be produced in a particularly compact physical manner, can be connected to a cable very easily and/or very quickly, and/or which can be produced highly advantageously because of a very simple design with only a small number of individual parts. This is because, in particular, the screw connection of the compression nut to the contact support, with the compression nut clasping the holding device, allows the cable connecting device to be designed with a very small size. Since a core holder is provided in the holding device, a cable core can be fixed very easily and quickly. In the end, the small number of components in comparison to the prior art also reduces the production costs.

The exemplary cable connecting device, which may be in the form of a power distributor and/or an electrical plug connector for electrically conductive connection of a cable to an electrical appliance or for electrically conductive connection of two cables, and/or which can be used as a cable connection device, for example to Ingress Protection Class IP 6X, allows a core of a stripped section of the cable to be "placed" in a core holder which is aligned radially with respect to the longitudinal axis of the cable connecting device, such that the core is positioned in the core holder such that the electrical contact can be made with the core particularly easily, for example from the direction of that end of the cable connecting device which faces the contact support. Furthermore, a core holder such as this makes it possible, for example, to automatically make the electrical contact with the core, since the core holder makes it possible to predetermine the position of the core on the holding device.

Furthermore, in some embodiments it is desirable for the contact support to have an external thread, onto which the compression nut can be screwed. Since the holding device can be pressed against the contact support by screwing up the compression nut, the fact that this allows the core to be fixed between the core holder and the contact support makes it possible to position the core such that the core cannot be moved even in response to loads involved with output applications. This makes it possible to ensure that the cable connecting device is less susceptible to defects.

In one exemplar embodiment, the holding device has a first opening and a second opening, the cable can be inserted into the cable connecting device through the first opening, and the cable can be passed out of the cable connecting device through the second opening. A refinement such as this makes it possible, for example, to route the cable line parallel from a cable channel to the cable connecting device. The first opening, the second opening and/or the cable may have the same profile. In other words, it may be desirable for the first opening and/or the second opening to have dimensions such that the cable rests flush on the first opening and/or on the second opening. It may be furthermore desirable for it to be possible to position the stripped section of the cable between the first opening and the second opening such that the cable is inserted through the first opening into the cable connecting device, the stripped section of the cable is then desirably provided immediately after this and, finally, the cable is then passed desirably directly out of the cable connecting device through the second opening.

According to a further exemplary embodiment, the holding device furthermore has a first opening and a second opening, the cable can be passed through the first opening into the cable connecting device, and the cable can be fastened in a closure sleeve in the second opening. According to this embodiment, the cable can thus be inserted into the cable connecting device through the first opening, the stripped section of the inserted cable or the core of the stripped section of the cable can be positioned in the core holder of the holding device, and that part of the cable which follows this can then be fastened in the closure sleeve in the second opening. For this purpose, one core of the cable can desirably be fastened in the closure sleeve. The closure sleeve very particularly desirably ends flush with the second opening.

In this context as well as in the already described exemplary embodiments with a cable inserted and a cable passed out, it may be desirable for it to be possible to position the cable in a semicircular shape by means of the holding device, such that the core holder is arranged in the semicircle formed in this way on the core of the stripped section of the cable positioned in the semicircle. Refinements such as these on the one hand allow electrical taps to be fitted in a simple manner to a "continuous" cable, while on the other hand allowing an electrical tap to be fitted at one end of the cable.

In principle, the holding device may be of any desired design. According to a further exemplary embodiment, however, the holding device is in the form of a seal. The seal can thus be pressed against the contact support by screwing the compression nut up onto the contact support, thus achieving a seal for the cable connecting device, in particular a seal for the cable holder, which is provided in the interior of the cable connecting device, and for the stripped section of the cable arranged around it. The seal for the cable connecting device can be designed to make it possible to comply with Ingress Protection Class IP 6X. In this context, it is furthermore desirable for the holding device to be in the form of a two-part seal such that the first opening and the second opening are formed by joining the seal parts together. For this purpose, the seal parts each half-surround the first opening and the second opening. Joining the seal parts together in this way makes it possible to arrange a seal, formed from two parts, very easily on the cable.

Furthermore, according to one development of an exemplary embodiment, it is desirable for it to be possible to design the core holder and the holding device as separate parts. For example, as stated above, the holding devices may be in the form of a seal, for example a rubberized seal, and the core holder may be formed from a material which is firmer than the seal, for example a plastic.

In principle, the core holder for positioning the core may be designed in any desired manner. According to one exemplary embodiment, however, the core holder may have a half shell for positioning of the core. It is furthermore desirable for it to be possible to position the core such that it rests flush in the half shell, and/or for the half shell to have a semicircular shape. A refinement such as this makes it possible to position the core exactly in the core holder.

According to a further exemplary embodiment, it is very desirable for a pierce contact to be provided for making electrically conductive contact with the core, and for it to be possible to pass the pierce contact through an opening in the contact support. In this context, it is furthermore desirable for the opening in the contact support to be arranged opposite the opening in the holding device. In other words, it is desirable for it to be possible to use a pierce contact to make electrically conductive contact with the core, that is to say in particular for the point of the pierce contact to make electrically conductive contact with the conductor in the core, through the insulation on the core.

The cable connecting device according to the exemplary embodiments can thus be connected to a cable by means of the following steps: stripping of a section of the cable. Turning the cable, such that the stripped section of the cable comes to rest in the turned area of the cable. Passing the turned cable through the compression nut, fitting the holding device to the cable, such that a core of the stripped section of the cable comes to rest on the holding device radially with respect to the longitudinal axis of the cable connecting device. Screwing the compression nut up onto the contact support, such that the compression nut clasps the holding device, the core holder faces the contact support, and the holding device can be pressed against the contact support by screwing up the compression nut. Introduction of a pierce contact into the contact support, such that the pierce contact makes electrically conductive contact with the core.

Furthermore, according to one exemplary development, the pierce contact is in the form of a pointed contact screw and with the contact screw having a female contact at the end remote from the point. This allows electrical appliances to be electrically conductively connected to the cable connecting device in a simple manner by means of the female contact.

According to one exemplary development, furthermore, a sealing washer is provided between the compression nut and the contact support. The sealing washer is desirably in the form of an O-ring seal. A sealing washer such as this allows sealing between the compression nut and the contact support, and prevents the ingress of moisture, for example.

In principle, the cable connecting device can be connected to other electrical devices by any desired means. According to a further exemplary embodiment, however, the contact support has a union nut for fastening the cable connecting device to a plug. A union nut such as this allows a safe and simple connection to the plug, for example an electrical plug connector. In this context, it is furthermore desirable for it to be possible to fasten the plug in a wall, and for the plug to have a contact pin for making electrically conductive contact with the pierce contact. The plug can be fastened in the wall of an electrical connecting socket, and/or in the wall of an electrical appliance.

In principle, a conductor in the core may have any desired cross section. According to a further exemplary embodiment, however, the cable connecting device can be used for a conductor cross section of the core of $\geq 6$ mm$^2$, desirably for $\geq 8$ mm$^2$, and very desirably for $\geq 10$ mm$^2$. A conductor cross section such as this makes it possible to apply a high current and/or to use the cable connecting device for applications which until now, as is known from the prior art, have been feasible only by means of a tap, for example a busbar. In this context, it is possible for the cable connecting device to be used for the electrically conductive connection of a preferably multicore cable to an electrical appliance, or for electrical connection of two preferably multicore cables.

The exemplary embodiments will be explained in more detail in the following text with reference to the drawing.

Figure 2A:
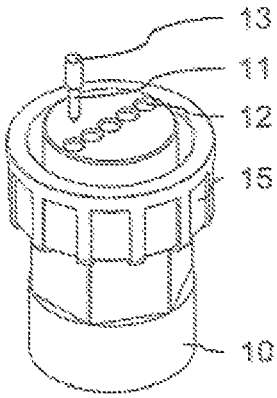
FIG. 2*a* shows a perspective view of a contact support for the cable connecting device according to an exemplary embodiment.
Figure 2B:
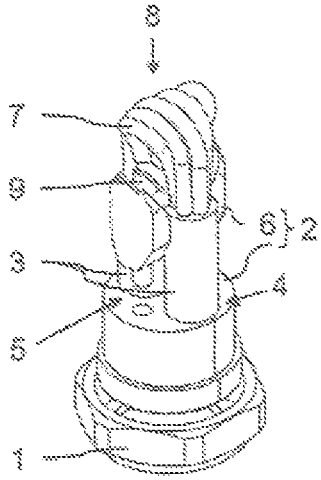
FIG. 2*b* shows a perspective view of a compression nut and a holding device for the cable connecting device according to an exemplary embodiment.
Figure 3A:
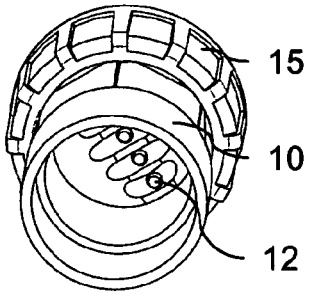
FIG. 3*a* shows a further perspective view of the contact support for the cable connecting device according to an exemplary embodiment.
Figure 3B:
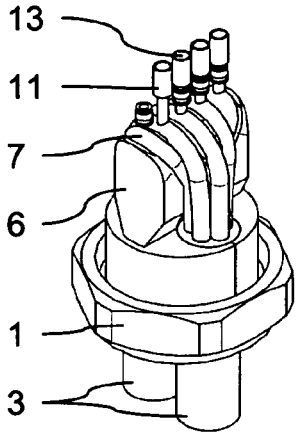
FIG. 3*b* shows a further perspective view of the compression nut and the holding device for the cable connecting device according to an exemplary embodiment.
Figure 4A:
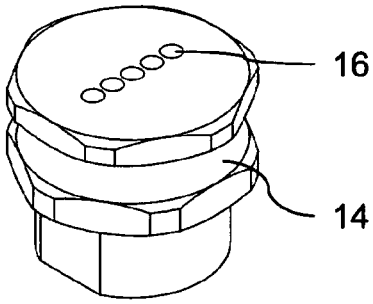
FIG. 4*a* shows a perspective view of a plug for the cable connecting device according to an exemplary embodiment.
Figure 4B:
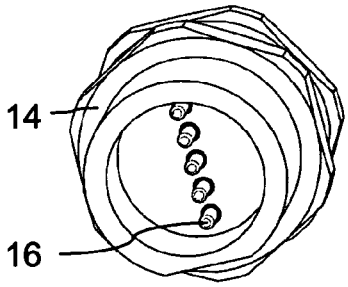
FIG. 4*b* shows a further perspective view of the plug for the cable connecting device according to an exemplary embodiment.
Figure 5A:
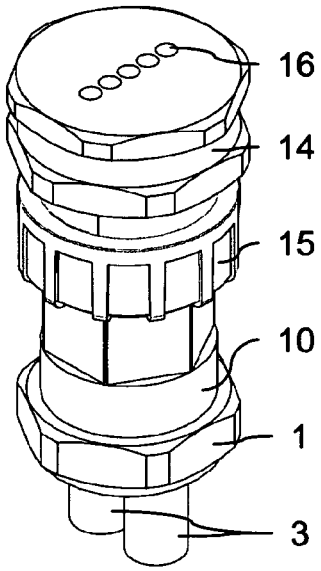
FIG. 5*a* shows a perspective view of the cable connecting device according to an exemplary embodiment.
Figure 5B:
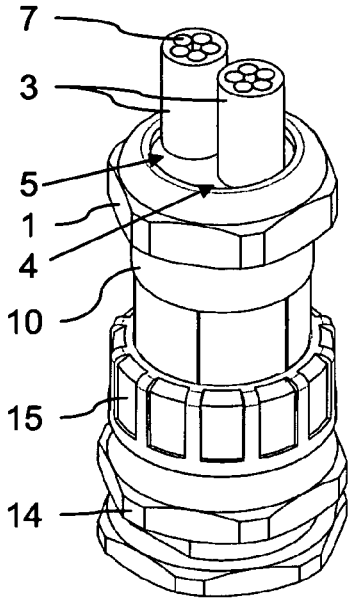
FIG. 5*b* shows a further perspective view of the cable connecting device according to an exemplary embodiment.

FIG. 1, FIG. 5*a* and FIG. 5*b* show a cable connecting device according to one exemplary embodiment, while FIG. 2*a* and FIG. 3*a* show a contact support for the cable connecting device according to the exemplary embodiment. FIG. 2*b* and FIG. 3*b* show a compression nut and a holding device for the cable connecting device according to the exemplary embodiment, and FIG. 4*a* shows a plug for the cable connecting device according to the exemplary embodiment.

The cable connecting device has a compression nut 1 and a holding device 2. A multicore cable 3 is inserted into the cable connecting device through the compression nut 1 and through an opening 4, 5 in the holding device 2. Specifically, the cable 3 is inserted into the cable connecting device through a first opening 4, and is passed out of the cable connecting device through a second opening 5, as can be seen in FIG. 5*b*. The cable 3 rests flush on the first opening 4 and on the second opening 5, as can be seen in FIG. 2*b* or FIG. 5*b*. In the present case, the holding device 2 is in the form of a two-part seal composed of a rubber-like material, as a slotted double seal, such that the first opening 4 and the second opening 5 are formed by joining the seal parts together.

Furthermore, the holding device 2 has a core holder 6, with the holding device 2 and the core holder 6 being in the form of separate parts. A core 7 of a stripped section 8 of the cable 3 can be positioned in the core holder 6, radially with respect to the longitudinal axis of the cable connecting device. For this purpose, the core holder 6 has a half shell 9, which is semicircular, as can be seen from FIG. 2*b* and FIG. 3*b*. A core 7 of the cable 3 is in this way positioned flush in the core holder 6.

The cable 3 is therefore inserted into the cable connecting device through the compression nut 1 and through the first opening 4 in the holding device 2, an inserted section 8 of the cable 3 is stripped, with the core 7 of the stripped section 8 of the cable 3 being positioned on the core holder 6 radially with respect to the longitudinal axis of the cable connecting device, and with the further course of the cable 3 being passed out of the cable connecting device through the second opening 5 in the holding device 2, and through the compression nut 1.

The compression nut 1 is screwed to a contact support 10 as can be seen, for example, in FIG. 1, FIG. 5*a* or FIG. 5*b*, such that the compression nut 1 clasps the holding device 2 such that, as can be seen from FIG. 1, the half shell 9 of the core holder 6 faces the contact support 10, and the holding device 2 can be pressed against the contact support 10 by screwing up the compression nut 1. A sealing washer 20 can be provided in order to improve the sealing between the compression nut 1 and the contact support 10.

A pierce contact 11, in the present case in the form of a pointed contact screw, is provided in order to make electrically conductive contact with a core 7. In this case, the pierce contact 11 is passed through an opening 12 in the contact support 10 such that the pierce contact 11 is inserted into the cable connecting device, opposite the cable 3. In order to make electrically conductive contact with the core 7, the pierce contact 11 pierces through insulation on the core 7, as indicated in FIG. 3*b*. At the end remote from the point, the pierce contact 11 has a female contact 13.

A union nut 15 is provided in order to fasten the cable connecting device to a plug 14. By way of example, the plug 14 can be fastened to a Wall via strap or fastening element 21, and has a contact pin 16 in order to make electrically conductive contact with the pierce contact 11. A seal 17, in the form of an O-ring seal, is provided between the plug 14 and the union nut 15.

The following procedure is therefore used, for example, for electrically conductively connecting the cable connecting device to a multicore cable 3: a section 8 of the cable 3 should be stripped such that the cores 7 in the stripped section 8 of the cable 3 can be seen. The cable 3 is turned such that the stripped section 8 of the cable 3 comes to rest in the turned area of the cable 3, which therefore forms a semicircle. The cable 3 which has been turned in this way should be passed through the compression nut 1. The core holder 6 should be fitted to the stripped section 8 of the cable 3, such that the cores 7 in the stripped section 8 of the cable 3 come to rest in the core holder 6. The seal parts should be assembled such that the first opening 4 surrounds the cable 3, and the second opening 5 surrounds the cable 3. The compression nut 1 should be screwed to the contact support 10 such that the compression nut 1 clasps the holding device 2, such that the core holder 6 faces the contact support 10, and the holding device 2 is pressed against the contact support 10 by screwing up the compression nut 1. The pierce contacts 11 should be introduced into the contact support 10 from the opposite side of the cable connecting device in the cable 3, such that each pierce contact 11 makes electrically conductive contact with a respective core 7.

The cable connecting device can be used for electrically conductive connection of a preferably multicore cable 3 to an electrical appliance, or for electrical connection of two preferably multicore cables 3. In this case, a conductor in the core 7 may have a cross section of $\geq 6\ mm^2$, desirably for $\geq 8\ mm^2$, and very desirably for $\geq 10\ mm^2$.

In the end, this results in a cable connecting device by means of which, for example, a "continuous" cable 3 and/or one end of a cable 3 can be connected to an electrical appliance, or two cables 3 can be connected to one another, in which case the cable connecting device can be produced particularly easily, and therefore advantageously, has a very compact design, allows a line to be routed parallel from a tap, for example from a cable channel, to the cable connecting device, can have particularly high currents applied to it and/or can be installed particularly easily and safely.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims.

The invention claimed is:

1. A cable connecting device for electrically conductive connection of a cable, comprising:

a compression nut;

a holding device with an opening and a core holder positioned vertically to the compression nut; and a contact support, wherein the cable can be passed through the compression nut and through the opening in the holding device, wherein a core of a stripped section of the cable can be positioned radially with respect to a longitudinal axis of the cable connecting device on the core holder, wherein the core holder has a half shell to position the core vertically and exactly in the core holder, and the compression nut can be screwed onto the contact support such that the compression nut clasps at one end of the holding device, the core holder facing the contact support, and the holding device can be pressed against the contact support by screwing up the compression nut.

2. The cable connecting device as in claim 1, wherein the cable is multicore.

3. The cable connecting device as in claim 1, wherein the opening is a first opening and the holding device further comprises a second opening, wherein the cable can be passed through the first opening into the cable connecting device, and the cable can be passed out of the cable connecting device through the second opening.

4. The cable connecting device as in claim 1, wherein the opening is a first opening and the holding device further comprising, a second opening, wherein the cable can be passed through the first opening into the cable connecting device, and the cable can be fastened in a closure sleeve in the second opening.

5. The cable connecting device as in claim 1, wherein the holding device is in a form of a seal.

6. The cable connecting device as in claim 5, wherein the holding device is in the form of a two-part seal, such that the first opening and the second opening are formed by joining the seal parts together.

7. The cable connecting device as in claim 1, wherein the core holder and the holding device are formed as separate parts.

8. The cable connecting device as in claim 1, further comprising, a pierce contact provided for making electrically conductive contact with the core, wherein the pierce contact can be passed through an opening in the contact support.

9. The cable connecting device as in claim 8, wherein the pierce contact is in the form of a pointed contact screw, and the contact screw has a female contact at an end remote from the point.

10. The cable connecting device as in claim 1, further comprising, a sealing washer being provided between the compression nut and the contact support.

11. The cable connecting device as in claim 1, wherein the contact support has a union nut for fastening the cable connecting device to a plug.

12. The cable connecting device as in claim 11, wherein the plug can be fastened in a wall, and the plug has a contact pin for making electrically conductive contact with a pierce contact provided for making electrically conductive contact with the core, wherein the pierce contact can be passed through an opening in the contact support.

13. The cable connecting device as in claim 1, wherein the cable connecting device can be used for a conductor cross section of the core of $\geq 6\ mm^2$ and $\leq 10\ mm^2$.

14. The cable connecting device as in claim 1, wherein the cable connecting device can be used for a conductor cross section of the core of $\geq 10\ mm^2$.

15. A method of electrically connecting of a cable to an electrical appliance, or for electrical connection of two cables, the method comprising: a connecting device comprising:

a compression nut;

a holding device with an opening and a core holder having a half shell for vertically and exact positioning to the holding device and the compression nut; and a contact support, passing the cable through the compression nut and through the opening in the holding device;

positioning a core of a stripped section of the cable radially with respect to a longitudinal axis of the cable connecting device on the half shell of the core holder; and screwing the compression nut onto the contact support such that the compression nut clasps at one end of the holding device, the core holder facing the contact support, and the holding device is pressed against the contact support by screwing up the compression nut.

16. The method as in claim 15, wherein the cable is multicore.

* * * * *